US010838353B2

(12) United States Patent
Matsumoto et al.

(10) Patent No.: US 10,838,353 B2
(45) Date of Patent: Nov. 17, 2020

(54) DEVELOPING APPARATUS

(71) Applicant: CANON KABUSHIKI KAISHA, Tokyo (JP)

(72) Inventors: Kazuki Matsumoto, Fuji (JP); Tsukasa Abe, Yokohama (JP); Kazutaka Sueshige, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/042,994

(22) Filed: Jul. 23, 2018

(65) Prior Publication Data

US 2019/0064731 A1 Feb. 28, 2019

(30) Foreign Application Priority Data

Aug. 30, 2017 (JP) ..... 2017-166002

(51) Int. Cl.
*G03G 21/18* (2006.01)
*G03G 15/08* (2006.01)
*G03G 21/16* (2006.01)

(52) U.S. Cl.
CPC ..... *G03G 21/1814* (2013.01); *G03G 15/0808* (2013.01); *G03G 21/1647* (2013.01); *G03G 21/1671* (2013.01); *G03G 21/1857* (2013.01); *G03G 2221/1657* (2013.01)

(58) Field of Classification Search
CPC ..... G03G 21/1857; G03G 21/186; G03G 21/1864; F16D 1/0882; F16D 1/087
See application file for complete search history.

(56) References Cited

U.S. PATENT DOCUMENTS 2,968,504 A * 1/1961 Hansen ..... G05G 1/12 403/357
3,130,990 A * 4/1964 Leitmann ..... G05G 1/12 403/357
3,329,452 A * 7/1967 Ammon ..... G05G 1/12 403/276

(Continued)

FOREIGN PATENT DOCUMENTS

CA 2986530 A1 * 6/2014 ..... G03G 21/1864
EP 2933685 A1 10/2015

(Continued)

OTHER PUBLICATIONS

English machine-translation of JP 2012-229723 (cited in IDS dated Jul. 23, 2018) (Year: 2012).*

*Primary Examiner* — Arlene Heredia
(74) *Attorney, Agent, or Firm* — Canon U.S.A., Inc. I.P. Division

(57) ABSTRACT

A developing apparatus includes a developer carrying member configured to carry developer, and a developer supply member configured to supply the developer to the developer carrying member, the developer supply member including a shaft, first and second driving members disposed at a first end and a second end of the shaft, respectively, and a toner supply unit disposed between the first end and the second end of the shaft, wherein the first driving member receives a driving force for rotating the developer supply member, and the second driving member outputs the driving force, and wherein the second driving member is mounted to the shaft without play in a rotational direction of the developer supply member with respect to the shaft.

6 Claims, 12 Drawing Sheets

(56) References Cited

U.S. PATENT DOCUMENTS

| | | | | |
|---|---|---|---|---|
| 3,961,855 | A * | 6/1976 | Basile | F16D 1/0835 403/329 |
| 6,496,667 | B2 * | 12/2002 | Shiratori | G03G 21/1857 399/103 |
| 8,756,787 | B2 * | 6/2014 | Zimmermann | F16D 1/0858 29/446 |
| 9,057,976 | B2 * | 6/2015 | Yoshida | G03G 15/0806 |
| 2005/0111882 | A1 | 5/2005 | Sudo | |

FOREIGN PATENT DOCUMENTS

| | | | |
|---|---|---|---|
| JP | 11-303972 | A | 12/1999 |
| JP | 2005-069239 | A | 3/2005 |
| JP | 04365150 | B2 | 11/2009 |
| JP | 2012-229723 | A | 11/2012 |
| JP | 2014-134787 | A | 7/2014 |
| KR | 10-2014-0043412 | A | 4/2014 |

* cited by examiner

DEVELOPING APPARATUS

BACKGROUND OF THE INVENTION

Field of the Invention

The present invention relates to a developing apparatus that is used in an electrophotographic image forming apparatus.

Description of the Related Art

In an electrophotographic image forming apparatus using an electrophotographic image forming process, a developing apparatus that causes toner to adhere to an electrostatic latent image formed on a photosensitive drum to develop an image is used. Japanese Patent Application Laid-Open No. 2014-134787 discusses a configuration in which a cartridge including a developer carrying member (development roller), a developer supply member (toner feed roller), and a toner storage chamber is detachably attached to an electrophotographic image forming apparatus. Japanese Patent Application Laid-Open No. 2014-134787 discusses the configuration in which a driving force input from a driving output unit of the image forming apparatus into a driving input unit of the cartridge is transmitted to the developer carrying member via the developer supply member to drive the developer carrying member.

In a case where a peripheral speed of the developer carrying member fluctuates, the fluctuation becomes a factor of a defective toner image. As a result, an image having a defect, such as uneven density, might be generated. As discussed in Japanese Patent Application Laid-Open No. 2014-134787, in the configuration in which a driving force is transmitted to the developer carrying member via the developer supply member, a fluctuation of the peripheral speed of the developer supply member brings the peripheral speed of the developer carrying member into fluctuating more easily compared to a configuration in which a driving force is input into the developer carrying member not via the developer supply member. Consequently, as a fluctuation of the peripheral speed of the developer carrying member is larger, uneven density of a developer on an image is recognized more easily. Therefore, an image might become a defective image.

SUMMARY OF THE INVENTION

According to an aspect of the present invention, a developing apparatus includes a developer carrying member configured to carry developer and be rotatable, and a developer supply member configured to be in contact with the developer carrying member, to supply the developer to the developer carrying member, and to be rotatable, the developer supply member including a shaft extending in a rotational axis direction of the developer carrying member, a first driving member and a second driving member disposed at a first end of the shaft and a second end of the shaft opposite to the first end in the rotational axis direction, respectively, and a toner supply portion disposed between the first end of the shaft and the second end of the shaft in the rotational axis direction, wherein the first driving member receives a driving force for rotating the developer supply member, and the second driving member outputs the driving force, and wherein the second driving member is mounted to the shaft without play in a rotational direction of the developer supply member with respect to the shaft.

Further features of the present invention will become apparent from the following description of exemplary embodiments with reference to the attached drawings.

DESCRIPTION OF THE EMBODIMENTS

[Whole Configuration of Image Forming Apparatus]

Figure 2:
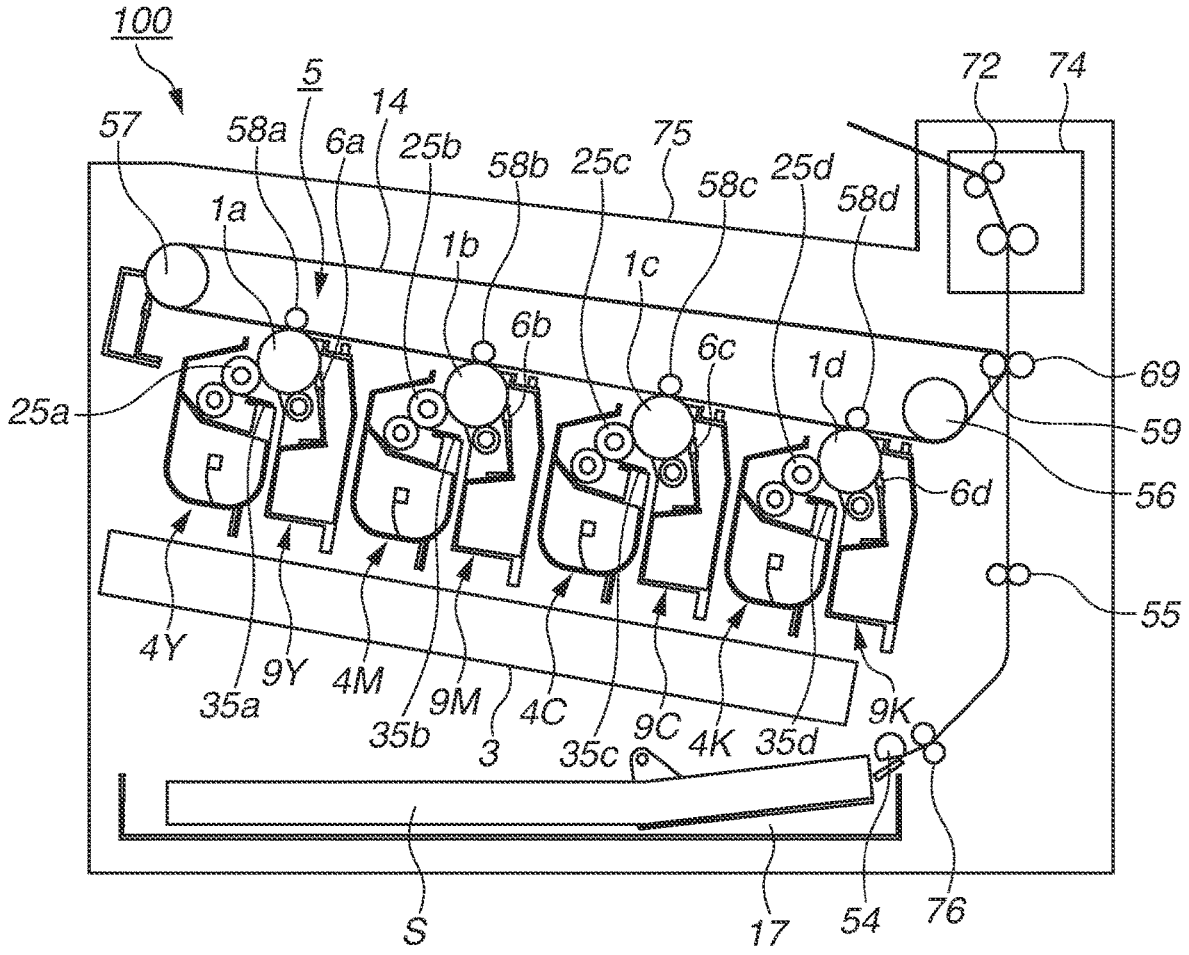
FIG. 2 is a schematic cross-sectional view illustrating an image forming apparatus.

A whole configuration of an electrophotographic image forming apparatus (hereinafter, image forming apparatus) 100 that forms an image on a recording medium S which is a sheet such as paper will be described with reference to FIG. 2. As illustrated in FIG. 2, four photosensitive drum carrying member cartridges (hereinafter, drum cartridges) 9 (9Y, 9M, 9C, and 9K) and four developing apparatuses (hereinafter, developing cartridges) 4 (4Y, 4M, 4C, and 4K) are mounted to the image forming apparatus 100. Further, an upstream side in a mounting direction of the drum cartridges 9 and the developing cartridges 4 which are the developing apparatuses in the image forming apparatus 100 is defined as a front surface side, and a downstream side in the mounting direction is defined as a back surface side. In FIG. 2, the drum cartridges 9 and the developing cartridges 4 are installed adjacent to each other so as to tilt with respect to a horizontal direction in the image forming apparatus 100.

In each of the drum cartridges 9, processing units are integrally disposed. The processing units include an electrophotographic photosensitive drum (hereinafter, photosensitive drum) 1 (1*a*, 1*b*, 1*c*, and 1*d*), a charge roller 2 (2*a*, 2*b*, 2*c*, and 2*d*), and a cleaning member 6 (6*a*, 6*b*, 6*c*, and 6*d*).

Further, in each of the developing cartridges 4 (4Y, 4M, 4C, and 4K), processing units are integrally disposed. The processing units include a development roller (developer carrying member) 25 (25*a*, 25*b*, 25*c*, and 25*d*) that can supply developer to the photosensitive drum 1 and a developing blade 35 (35*a*, 35*b*, 35*c*, and 35*d*).

The charge roller 2 uniformly charges the surface of the photosensitive drum 1. The development roller 25 develops a latent image formed on the photosensitive drum 1 by using the developer (hereinafter, toner) to visualize the image. The cleaning member 6 removes residual toner on the photosensitive drum 1 after the toner image formed on the photosensitive drum 1 (developer images) is transferred to the recording medium S.

Further, a scanner unit 3 is disposed below the drum cartridges 9 and the developing cartridges 4. The scanner unit 3 is for selectively exposing the photosensitive drums 1 based on image information, and forming latent images on the photosensitive drums 1, respectively.

A cassette 17 that contains the recording media S is mounted to a lower part of the image forming apparatus 100. A recording medium conveyance device is disposed so that each of the recording media S passes through a secondary transfer roller 69 and a fixing unit 74 to be conveyed to an upper part of the image forming apparatus 100. That is, a feed roller 54 that feeds the recording media S in the cassette 17 one by one, a conveyance roller pair 76 that conveys a fed recording medium S, and a registration roller pair 55 that synchronizes latent images formed on the photosensitive drums 1 with the recording medium S are disposed. Further, an intermediate transfer unit 5 which is intermediate transfer means is disposed above the drum cartridges 9 and the developing cartridges 4. The intermediate transfer unit 5 is for transferring toner images formed on the photosensitive drums 1 (1*a*, 1*b*, 1*c*, and 1*d*). The intermediate transfer unit 5 includes a driving roller 56, a driven roller 57, primary transfer rollers 58 (58*a*, 58*b*, 58*c*, and 58*d*), and an opposed roller 59. Each of the primary transfer rollers 58 is disposed at a position opposed to the photosensitive drum 1 having a different color. The opposed roller 59 is disposed in a position opposed to the secondary transfer roller 69. A transfer belt 14 is installed across the intermediate transfer unit 5. The transfer belt 14 rotates such that the transfer belt 14 opposes to and is in contact with all the photosensitive drums 1, and a voltage is applied to the primary transfer rollers 58 (58*a*, 58*b*, 58*c*, and 58*d*). As a result, primary transfer from the photosensitive drums 1 onto the transfer belt 14 is performed. Application of a voltage to the opposed roller 59 and the secondary transfer roller 69 disposed in the transfer belt 14 causes toner of the transfer belt 14 to be transferred to the recording medium S.

At a time of image formation, the scanner unit 3 selectively exposes the photosensitive drums 1 which are rotated to be uniformly charged by the charge rollers 2. As a result, electrostatic latent images are formed on the photosensitive drums 1, respectively. The latent images are developed by supplying toner from the development rollers 25. Toner images of respective colors are then formed on the photosensitive drums 1. In synchronization with the image formation, the registration roller pair 55 conveys the recording medium S to a secondary transfer position where the opposed roller 59 is in contact with the secondary transfer roller 69 via the transfer belt 14. A transfer bias voltage is applied to the secondary transfer roller 69 for performing secondary transfer of the toner images of respective colors from the transfer belt 14 to the recording medium S. Thus, a color image is formed on the recording medium S. The recording medium S on which the color image has been formed is heated and pressurized by the fixing unit 74 so that the toner images are fixed. Thereafter, the recording medium S is discharged to a discharge portion 75 by a discharge roller 72. The fixing unit 74 is disposed on an upper part of the image forming apparatus 100.

[Drum Cartridge]

Figure 3:
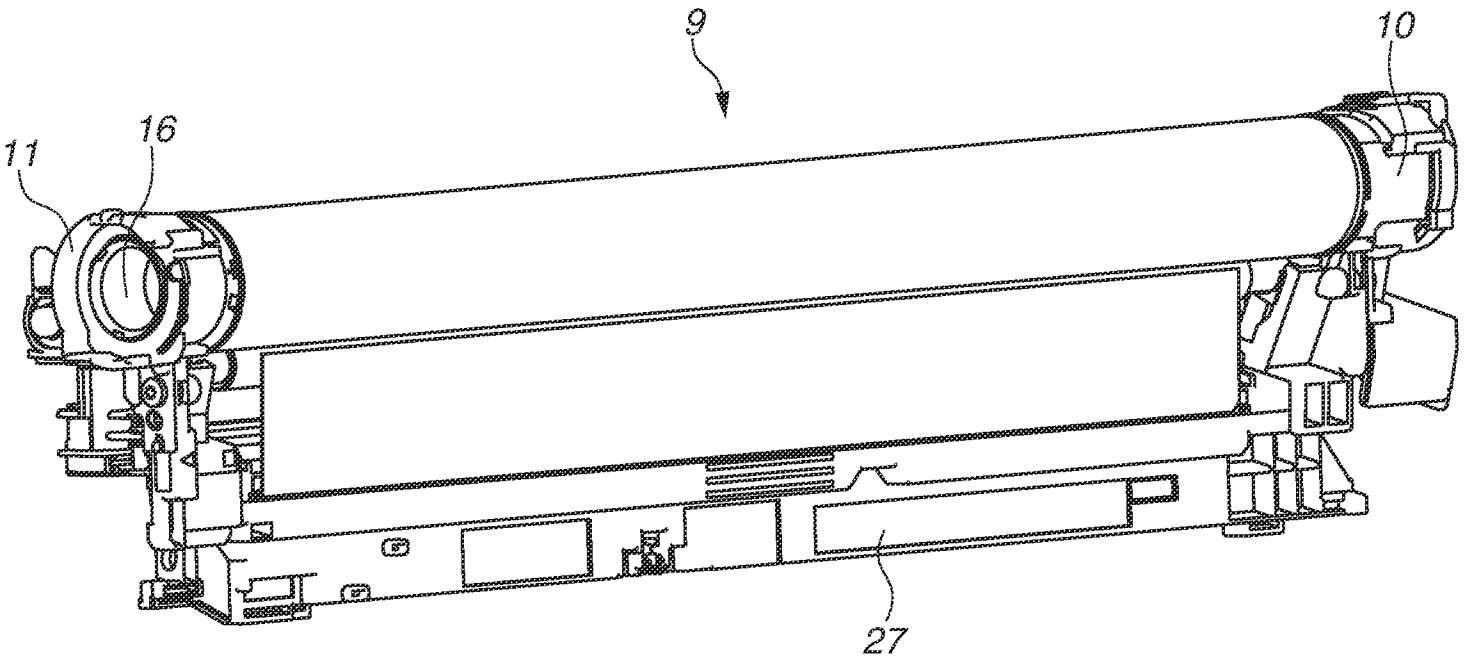
FIG. 3 is a schematic perspective view illustrating a drum cartridge.

The drum cartridges 9 according to the present exemplary embodiment of the present invention will be described below with reference to FIGS. 3 and 4. FIG. 3 is an explanatory diagram illustrating a configuration of the drum cartridges 9 (9Y, 9M, 9C, and 9K). The drum cartridges 9Y, 9M, 9C, and 9K have the similar configuration. In the present exemplary embodiment, an upstream side in an insertion direction of the drum cartridge 9 and the developing cartridges 4, described below, is defined as a front side, and a downstreamside thereof is defined as a back side.

The photosensitive drum 1 is disposed in a cleaning frame 27 of the drum cartridge 9 (9Y, 9M, 9C, and 9K) via a drum front bearing 10 and a drum back bearing 11 so as to freely rotate. A drum coupling 16 and a flange are disposed at one end in an axial direction of the photosensitive drum 1.

Figure 4:
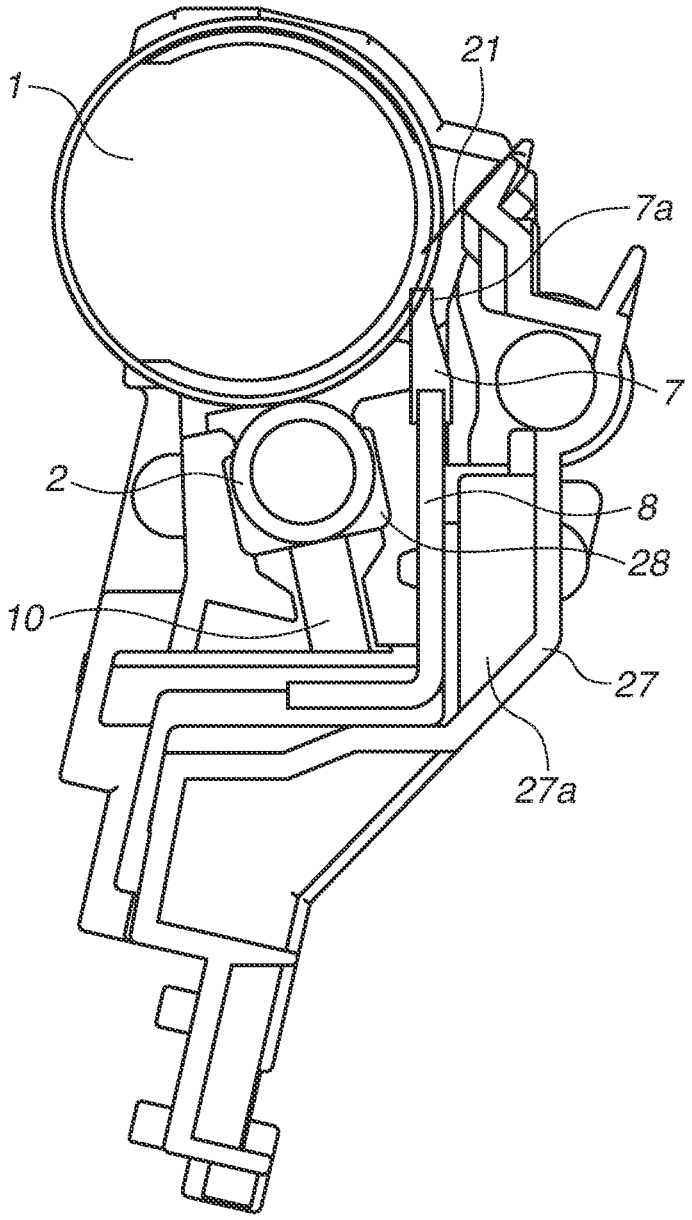
FIG. 4 is a schematic cross-sectional view illustrating the drum cartridge.

FIG. 4 is a cross-sectional view illustrating the drum cartridge. As described above, the charge roller 2 and the cleaning member 6 are disposed around the photosensitive drum 1. The cleaning member 6 includes an elastic member 7 made of a rubber blade, and a cleaning support member 8. A leading edge 7*a* of the elastic member (rubber blade) 7 is disposed such that the leading edge 7*a* is in contact with the photosensitive drum 1 in a direction opposite to a rotational direction. The cleaning member 6 removes residual toner from the surface of the photosensitive drum 1 and the residual toner drops into a residual toner chamber 27*a*. Further, a scoop sheet 21 that prevents the residual toner in the residual toner chamber 27*a* from leaking is in contact with the photosensitive drum 1. A driving force of a main body drive motor (not illustrated) as a drive source is transmitted to the drum cartridge 9 so that the photosensitive drum 1 is driven and rotated in accordance with an image forming operation. The charge roller 2 is rotatably mounted to the drum cartridge 9 via a charge roller bearing 28. The charge roller 2 is pressed against the photosensitive drum 1 by a charge roller pressing member 46 and is rotationally driven and rotated in accordance with the photosensitive drum 1.

[Developing Cartridge]

Figure 5:
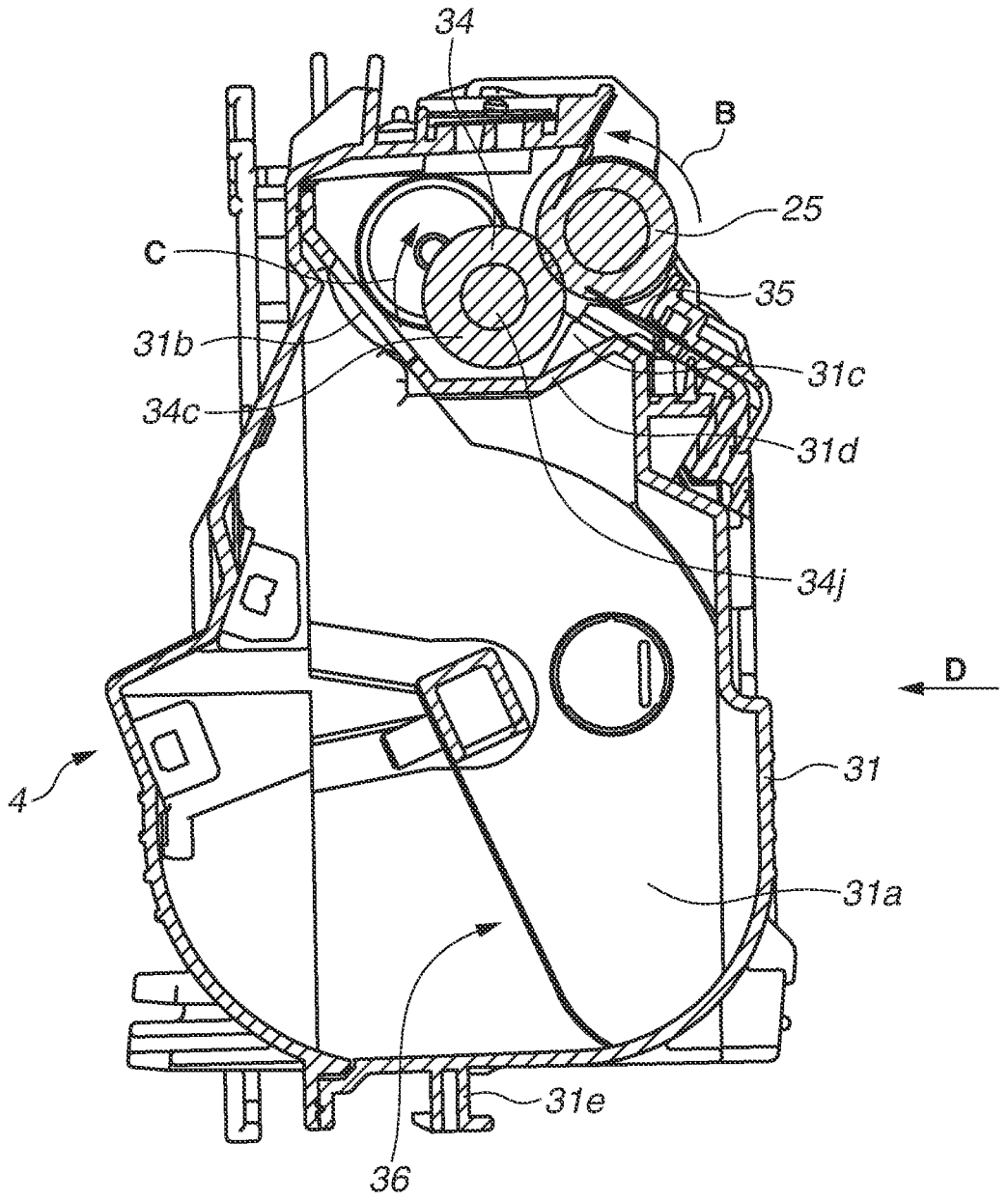
FIG. 5 is a schematic cross-sectional view illustrating a developing cartridge.

The developing cartridge 4 will be described below with reference to FIG. 5. FIG. 5 illustrates a main cross section of the developing cartridge 4 (4Y, 4M, 4C, and 4K) that contain toner. The developing cartridge 4Y containing yellow toner, the developing cartridge 4M containing magenta toner, the developing cartridge 4C containing cyan toner, and the developing cartridge 4K containing black toner have the similar configuration.

The developing cartridge 4 includes the development roller (developer carrying member) 25, a toner feed roller (developer supply member) 34, the developing blade 35 for regulating a toner layer on the development roller 25, a toner conveyance member 36, and a developing frame 31 that supports these above units. The development roller 25 is in contact with the photosensitive drum 1, and supplies toner to the surface of the photosensitive drum 1. The toner feed roller 34 is in contact with the development roller 25, and supplies toner to the development roller 25. The developing blade 35 regulates a thickness of the toner layer on the development roller 25.

The developing frame 31 includes a developing chamber 31*c* having the development roller 25, and a toner storage chamber 31*a* disposed below the developing chamber 31*c*. The respective chambers are divided by a partition 31*d*. Further, the partition 31*d* has an opening 31*b* through which toner passes when the toner is conveyed from the toner storage chamber 31*a* to the developing chamber 31*c*. Furthermore, the developing frame 31 is provided with an urged portion 31*e* that is urged by an urging member, not illustrated, of the image forming apparatus 100.

The development roller 25 and the toner feed roller 34 are rotatably supported by bearings, not illustrated. The bearings are provided on both sides, respectively, in an axial direction of the development roller 25 in the developing frame 31. Rotational axes of the development roller 25 and the toner feed roller 34 are parallel with each other.

The toner feed roller 34 includes a toner feed roller shaft 34*j* and a toner supply unit (developer supply unit) 34*c* which is an elastic foam layer (sponge layer) covering the toner feed roller shaft 34*j*. A D-shaped hole of a driving force input member (first driving member) 37 is engaged with a driving input unit 34*a* having D-shaped cross section provided at one end of the toner feed roller shaft 34*j* in an axial direction of the toner feed roller shaft 34*j*. The driving force input member 37 is a coupling into which a driving force is input (see FIG. 8). The driving force input member 37 is engaged with a driving output unit (coupling), not illustrated, provided to the image forming apparatus 100. The driving force input member 37 thus receives a driving force to rotate. A transmission member (second driving member) 38 which is a gear for transmitting a driving force is mounted to a driving force transmission portion 34*b*. The driving force transmission portion 34*b* has a D-shaped cross section and is provided at the other end of the toner feed roller shaft 34*j* in the axial direction of the toner feed roller 34 (see FIG. 8). The driving force input member 37, the toner supply unit 34*c*, and the transmission member 38 are disposed in this order in the axial direction of the toner feed roller shaft 34*j* (see FIG. 8). That is, the toner supply unit 34*c* is disposed between the driving force input member 37 and the transmission member 38 in the axial direction.

The development roller 25 includes a development roller shaft 25*a* and a toner carrying unit (developer carrying portion) 25*b* which is a rubber layer covering the development roller shaft 25*a*. The other end of the development roller shaft 25*a* in the axial direction of the development roller 25 has a D-shaped cross section. A hole having D-shaped cross section of a transmission member (third driving member) 39 (see FIGS. 7A, 7B, and 7C) is engaged with the other end. The transmission member 39 is a gear different from the transmission member 38 and is in gear with the transmission member 38.

The toner conveyance member 36 is disposed in the toner storage chamber 31*a* of the developing frame 31. The toner conveyance member 36 agitates the stored toner and conveys the toner to the developing chamber 31*c* via the opening 31*b*. A distance between a rotational axis of the toner feed roller 34 and a rotational axis of the development roller 25 are determined in such a manner that the toner supply unit 34*c* is in contact with the toner carrying unit 25*b* with a predetermined inroad amount. That is, the toner supply unit 34*c* is in contact with the toner carrying unit 25*b* in a state that the toner supply unit 34*c* is compressed between the toner carrying unit 25*b* and the toner feed roller shaft 34*j*.

[Mounting of Cartridge]

Figure 6:
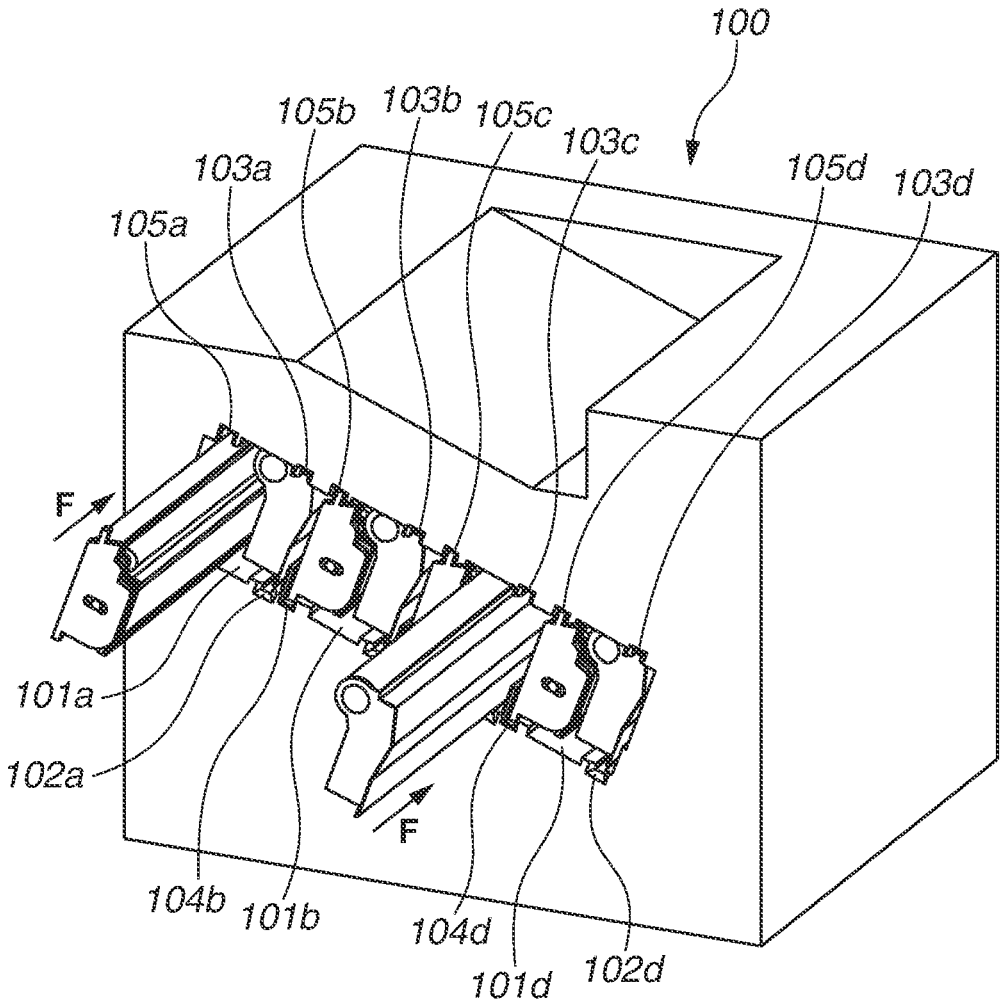
FIG. 6 is a perspective view illustrating a state that the drum cartridge and the developing cartridge are mounted to the image forming apparatus.

A configuration where the drum cartridges 9 and the developing cartridges 4 are inserted into the image forming apparatus 100 will be described below with reference to FIG. 6. In the present exemplary embodiment, the drum cartridges 9 (9Y, 9M, 9C, and 9K) and the developing cartridges 4 (4Y, 4M, 4C, and 4K) are inserted into openings 101 (101*a*, 101*b*, 101*c*, and 101*d*), respectively. Specifically, the drum cartridges 9 and the developing cartridges 4 are inserted from a front side toward a back side in a direction (a direction of arrow F in the drawing) parallel with the axial direction of the photosensitive drums 1 (1*a*, 1*b*, 1*c*, and 1*d*). In the present exemplary embodiment, an upstream side in the insertion direction of the drum cartridges 9 and the developing cartridges 4 is defined as the front side, and a downstream side thereof is defined as the back side.

Upper guide units 103 (103*a*, 103*b*, 103*c*, and 103*d*) as first main body guide units are disposed on an upper portion of the image forming apparatus 100. Lower guide units 102 (102*a*, 102*b*, 102*c*, and 102*d*) as second main body guide units are disposed on a lower portion. Each of the upper guide units 103 and each of the lower guide units 102 are configured into a guide shape so as to extend along an insertion direction F of the drum cartridge 9. The drum cartridge 9 is placed on the front side of the lower guide unit 102 in the mounting direction, and the drum cartridge 9 is moved along the upper guide unit 103 and the lower guide 102 toward the insertion direction F. In such a manner, the drum cartridge 9 is inserted into the image forming apparatus 100.

Also in a case where the developing cartridge 4 are inserted, similarly to the drum cartridge 9, the developing cartridge 4 is placed, in a mounting direction, on the front side of upper guide 105 disposed on the upper portion of the image forming apparatus 100 and the front side of lower guide 104 disposed the lower portion of the image forming apparatus 100. The developing cartridge 4 is moved along the upper guide unit 105 and the lower guide unit 104 to the insertion direction F. In such a manner, the developing cartridge 4 is moved along the upper guide unit 105 is inserted into the image forming apparatus 100.

[Driving Force Transmission Configuration in Developing Cartridge]

Figure 7B:
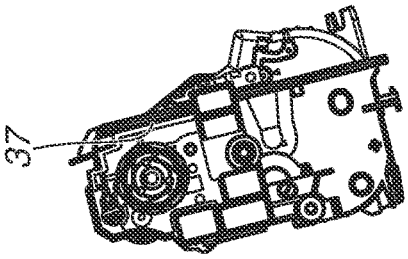
FIGS. 7A, 7B, and 7C are three-view drawings illustrating the developing cartridge.
Figure 7A:
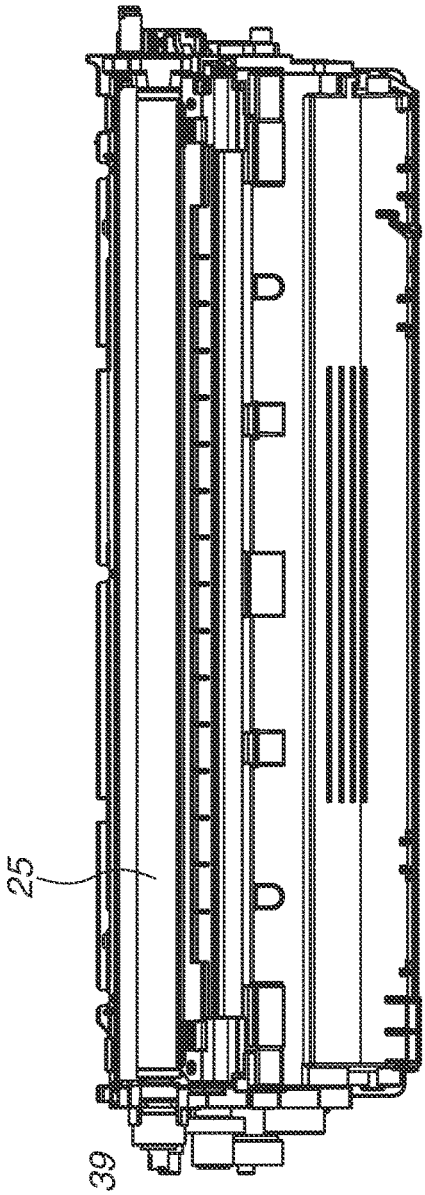
Figure 7C:
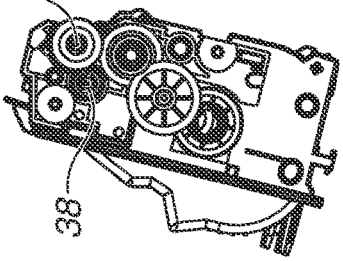
Figure 8:
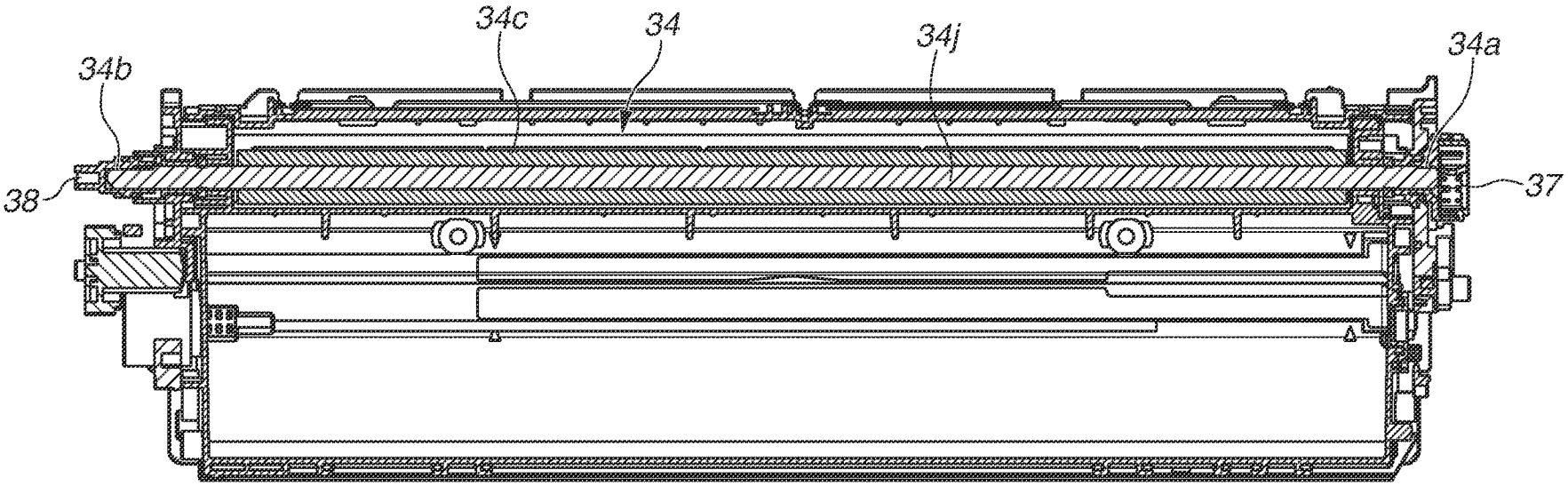
FIG. 8 is a schematic cross-sectional view illustrating the developing cartridge.

A driving force transmission mechanism in the developing cartridges 4 will be described with reference to FIGS. 7A, 7B, and 7C, and FIG. 8. FIG. 7A is a diagram illustrating the developing cartridge 4 viewed from a direction of an arrow D in FIG. 5 perpendicular to the rotational axis of the development roller 25. FIG. 7B is a diagram illustrating the developing cartridge 4 viewed from a side of the transmission member 38 in the rotational axis direction of the development roller 25, and a left side diagram of FIG. 7A which is a front side view. FIG. 7C is a diagram illustrating the developing cartridge 4 viewed from a side of the driving force input member 37 in the rotational axis direction of the development roller 25, and a right side view of FIG. 7A which is the front side view. FIG. 7C is the side view illustrating the transmission member 38. FIG. 8 is a cross-sectional view illustrating the developing cartridges 4 viewed from a direction perpendicular to the rotational axis of the toner feed roller 34. This cross section passes through the toner feed roller 34. The developing cartridge 4 is configured such that a driving force is input from the driving output unit, not illustrated, of the image forming apparatus 100 into the driving force input member 37, the driving force is transmitted to the driving input unit 34*a* to which the developing cartridge 4 is engaged, and thus the toner feed roller 34 is driven and rotated. Then, the driving force is transmitted from the transmission member 38 engaged with the driving force transmission portion 34*b* to the transmission member 39 and from the transmission member 39 to the development roller shaft 25*a*. As a result of such transmission, the development roller 25 is driven and rotated.

When the driving force is input to the driving force input member 37, the development roller 25 is rotated to a direction of an arrow B illustrated in FIG. 5, and the toner feed roller 34 is rotated to a direction of an arrow C illustrated in FIG. 5. More specifically, the development roller 25 and the toner feed roller 34 rotate in opposite directions, and the toner supply unit 34*c* and the toner carrying unit 25*b* move to an identical direction at a portion where the development roller 25 contacts with the toner feed roller 34.

Figure 1:
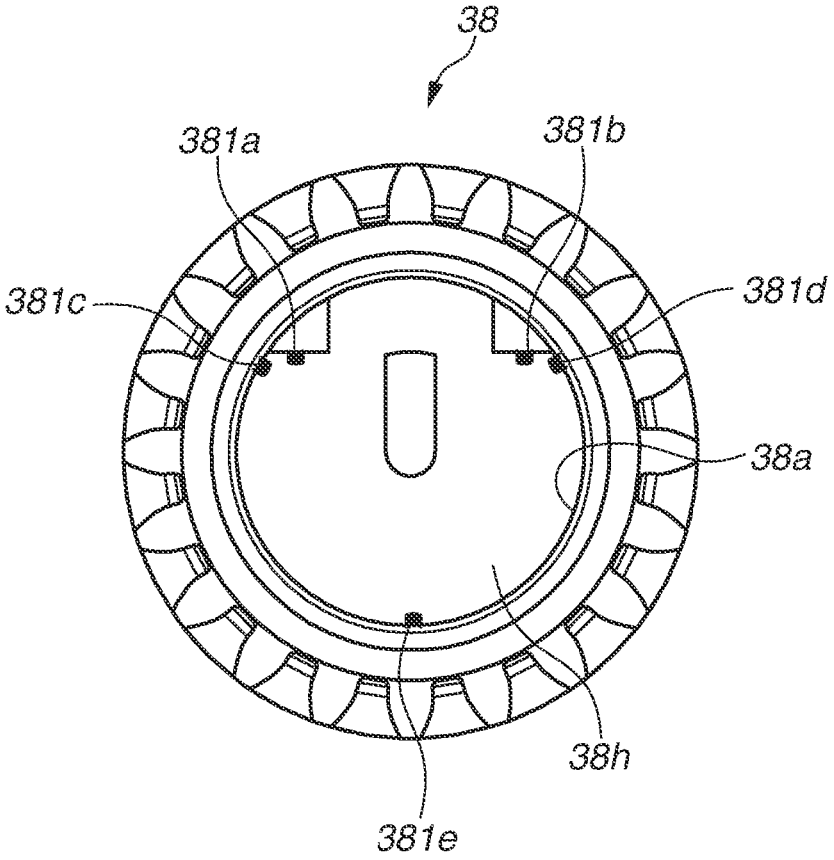
FIG. 1 is a diagram illustrating a transmission member viewed from an axial direction.
Figure 9:
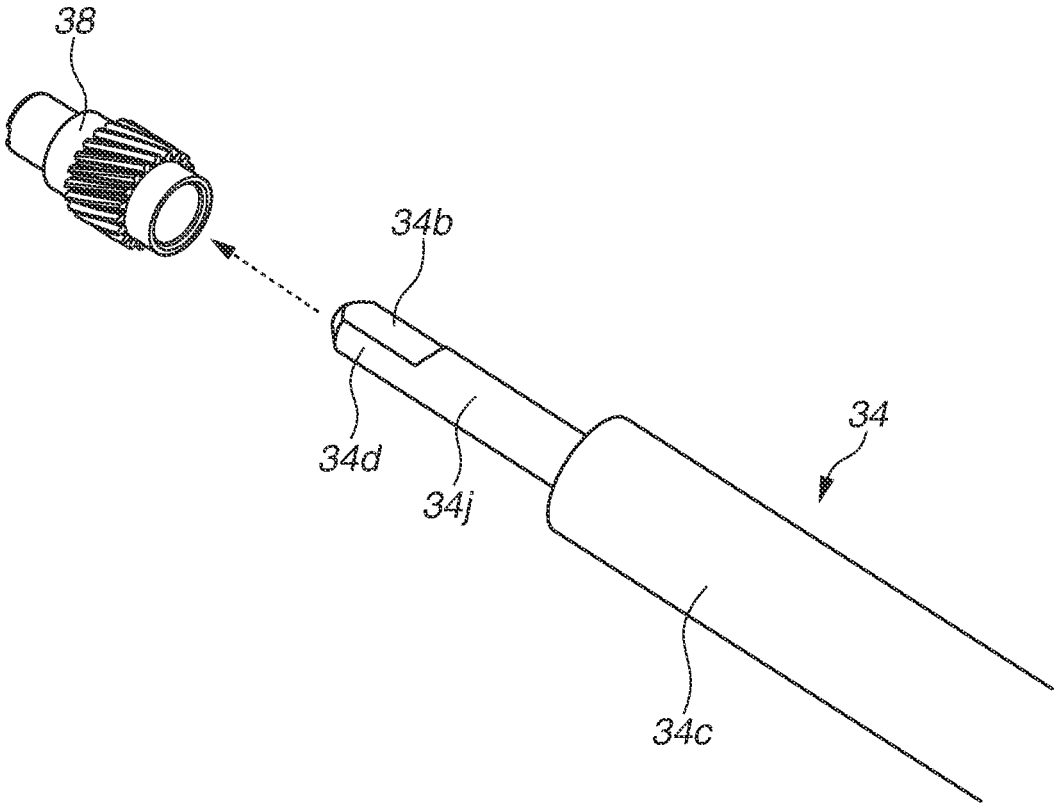
FIG. 9 is a perspective view illustrating a driving force transmission portion and a transmission member.

Details of the engaged portion between the driving force transmission portion 34*b* and the transmission member 38 are illustrated in FIG. 9 and FIG. 1. FIG. 9 is a perspective view illustrating a state before the engagement between the driving force transmission portion 34*b* and the transmission member 38. As illustrated in FIG. 9, the transmission member 38 is a gear and is engaged with a portion, which is cut into a D shape, at the end of the toner feed roller 34. Any shape which prevents rotation of the driving force transmission portion 34*b* in the transmission member 38 may be used for the cross section of the engagement portion of the transmission member 38 and the driving force transmission portion 34*b*. The shape may be a non-circular shape such as a shape having at least one flat face, such as the D shape illustrated, or a polygonal cross section such as a hexagonal or square cross section. FIG. 1 is a diagram illustrating the transmission member 38 viewed from a rotational axis direction of the transmission member 38. As illustrated in FIG. 1, a plurality of ribs 381 (381*a*, 381*b*, 381*c*, 381*d*, and 381*e*) is disposed on an inner peripheral surface 38*a* forming a hole 38*h* of the transmission member 38. Specifically, the plurality of ribs 381 is disposed on a portion for engaging with the other end of the toner feed roller shaft 34*j* including the driving force transmission portion 34*b*. Alternatively, a plurality of ribs may be provided on the driving force transmission portion 34*b* for engaging with the inner peripheral surface 38*a* of the hole 38*h*.

Figure 10:
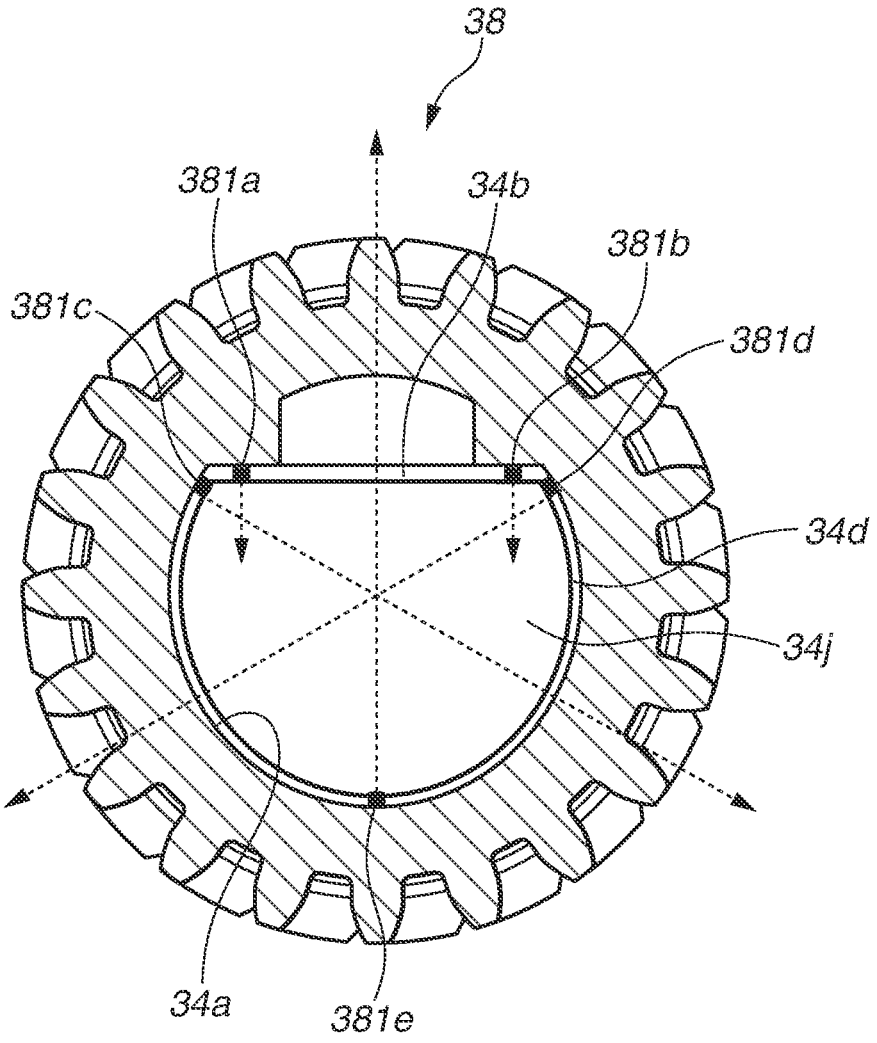
FIG. 10 is a cross-sectional view illustrating the driving force transmission portion and a toner feed roller shaft viewed from an axial direction.

The layout of the plurality of ribs 381 on the engagement portion between the toner feed roller 34 and the transmission member 38 will be described below with reference to FIG. 10. FIG. 10 is a cross-sectional view illustrating the toner feed roller shaft 34*j* and the transmission member 38 viewed from the rotational axis of the toner feed roller 34. Since the driving force transmission portion 34*b* is disposed, the other end of the toner feed roller shaft 34*j* in the axial direction of the toner feed roller shaft 34*j* has a D-shaped cross section (D-cut shape) by the driving force transmission portion 34*b* and an arc surface 34*d*.

The transmission member 38 has the hole 38*h* that extends to the rotational axis direction of the toner feed roller 34. The other end of the toner feed roller shaft 34*j* is fitted into the hole 38*h*. The inner peripheral surface 38*a* forming the hole 38*h* has the ribs 381*a* and 381*b*, and also the ribs 381*c*, 381*d*, and 381*e*. The ribs 381*a* and 381*b* cause the transmission member 38 to be press-fitted (interference-fitted) into the driving force transmission portion 34*b*. The ribs 381*c*, 381*d*, and 381*e* cause the transmission member 38 to be press-fitted (interference-fitted) into the arc surface 34*d*. The ribs 381*a*, 381*b*, 381*c*, 381*d*, and 381*e* are projections that project from the inner peripheral surface 38*a* toward the toner feed roller shaft 34*j*. A projecting direction is indicated by an arrow of a dotted line. The ribs 381*a* and 381*b* are in contact with the driving force transmission portion 34*b*. The ribs 381*c*, 381*d*, and 381*e* are in contact with an arc surface 34*d*. With such a configuration, the transmission member 38 is fitted into the driving force transmission portion 34*b* of the toner feed roller shaft 34*j* without clearance (play) between the transmission member 38 and the toner feed roller shaft 34*j* in a rotational direction of the toner feed roller shaft 34*j*. That is, the rib 381*b* as a driving force reception unit receives a rotational driving force mainly from the driving force transmission portion 34*b*. However, the rib 381*b* is pressed against the driving three transmission portion 34*b* and is in contact with the driving force transmission portion 34*b*. That is, the rib 381*b* pressure-contacts with the driving force transmission portion 34*b*.

In the present exemplary embodiment, in a case where a shaft diameter of the toner feed roller 34 is φ7, the inner peripheral surface 38*a* of the transmission member 38 has a gap of about 25 μm with respect to the driving force transmission portion 34*b* and the arc surface 34*d* of the toner feed roller 34. Because of the ribs 381 having a height of about 40 μm, play in the gap can be suppressed, and play between the toner feed roller shall 34*j* and the transmission member 38 in the rotational direction of the toner feed roller shaft 34*j* can be thus suppressed.

If the ribs 381 are not provided, the transmission member 38 is fitted into the driving force transmission portion 34*b* with play in the rotational direction of the toner feed roller shaft 34*j* due to a gap between the driving force transmission portion 34*b* and the transmission member 38. In a case where play is present between the driving force transmission portion 34*b* and the transmission member 38, a driving force is transmitted after the toner feed roller 34 is driven and the driving force transmission portion 34*b* rotates by an amount of play and butts against the transmission member 38. Therefore, in a driving state, there is play on an upstream side in the rotational direction before a portion where the driving force transmission portion 34*b* butts against the transmission member 38. If a load change occurs in the toner feed roller 34 in a state that play is present, a phase might shift within a range of the play in the rotational direction of the driving force transmission portion 34*b* and the transmission member 38. This phase shift causes a fluctuation of the peripheral speed of the toner feed roller 34 in N rotational periods (N is a natural number), in the development roller 25 as a driving transmission destination.

On the other hand, in a case where the ribs 381 are provided, play is not present in the rotational direction of the toner feed roller shaft 34*j*. For this reason, a phase shift can be suppressed in the rotational direction of the driving force transmission portion 34*b* and the transmission member 38. Therefore, a fluctuation of the peripheral speed of the toner feed roller 34 in the N rotational periods can be suppressed in the development roller 25. If a fluctuation of the peripheral speed of the development roller 25 is suppressed, images irregularities can be suppressed.

The toner supply unit 34*c* of the toner feed roller 34 is a flexible member. The toner supply unit 34*c* is in contact with and makes a predetermined amount of inroads into the development roller 25. For this reason, the toner supply unit 34*c* is held so as to be partially pressed to the development roller 25 and compressed. Therefore, during the rotation of the toner feed roller 34, an outer shape of the toner supply unit 34*c* is uniform until the compressed part of the toner supply unit 34*c* returns to an original shape. Accordingly, the rotational load of the toner feed roller 34 easily fluctuates. The transmission member 38 is thus fitted into the toner feed roller 34, where the rotational load easily fluctuates in the above described manner, without play in the rotational direction of the toner feed roller shaft 34*j*. With such a configuration, a fluctuation of the peripheral speed of the development roller 25 can be effectively suppressed. Therefore, image irregularities caused by a fluctuation of the peripheral speed of the development roller 25 can be suppressed.

Since the ribs 381 are provided, in a case where the transmission member 38 is mounted to the toner feed roller shaft 34*j*, the transmission member 38 has to be press-fitted into the driving force transmission portion 34*b*.

In the present exemplary embodiment, the driving force input member 37 is fitted into the driving input unit 34*a* of the toner feed roller shaft 34*j* such that play is present in the rotational direction of the toner feed roller shaft 34*j*. Further, the transmission member 39 is fitted into the development roller shaft 25*a* such that play is present in a rotational direction of the development roller shaft 25*a*.

However, in addition to the above described form, the driving force input member 37 can be fitted into the driving input unit 34*a* of the toner feed roller shaft 34*j* without play in the rotational direction of the toner feed roller shaft 34*j*. Similarly, in addition to the above described form, the transmission member 39 can be fitted into the development roller shaft 25*a* without play in the rotational direction of the development roller shaft 25*a*. In order to fit the members without play, ribs similar to the ribs 381 can be provided to the driving force input member 37 and the transmission member 39.

A configuration, as described above, that the transmission member 38 is mounted to the toner feed roller shaft 34*j* without play is a configuration A. A configuration that the driving force input member 37 is mounted to the toner feed roller shaft 34*j* without play is a configuration B. A configuration that the driving force input member 37 is mounted to the development roller shaft 25*a* without play is a configuration C. A suppressing effect on a fluctuation of the peripheral speed of the development roller 25 in the configurations A, B, and C will be described.

Figure 12A:
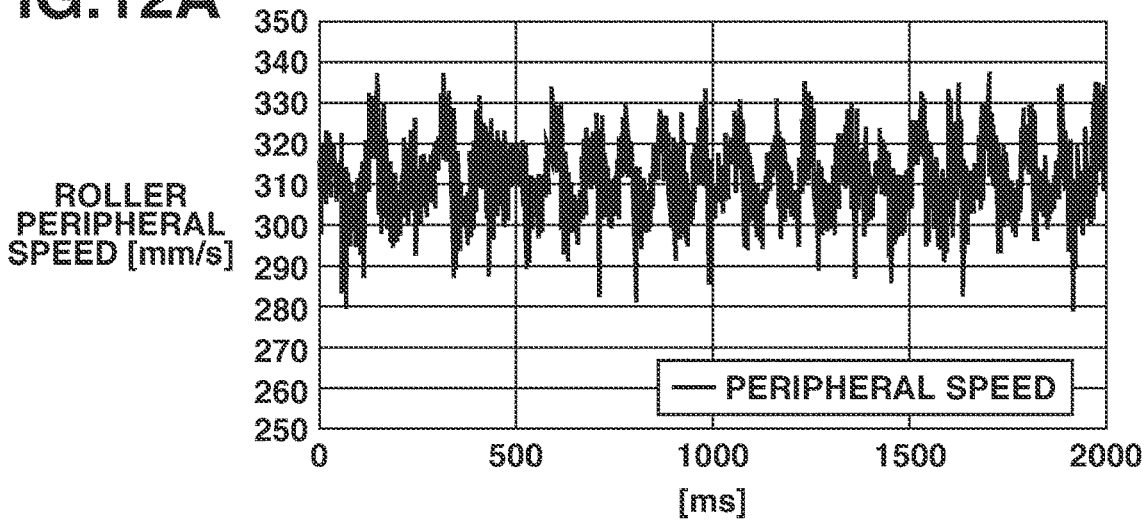
FIGS. 12A, 12B, and 12C are graphs illustrating a fluctuation of a peripheral speed of a development roller.
Figure 12B:
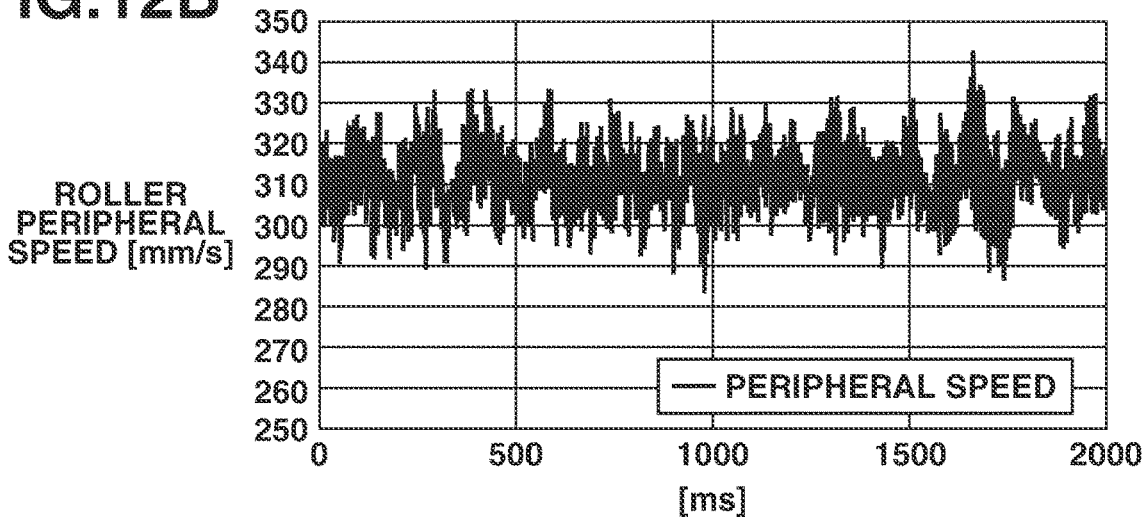
Figure 12C:
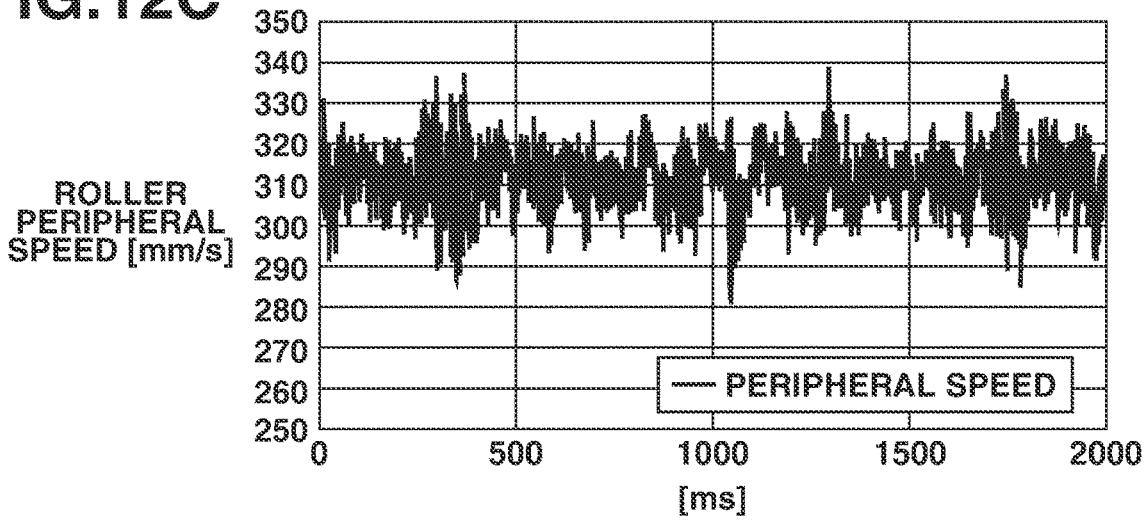

According to a study by Inventors, the configuration A is the most effective in suppressing a fluctuation of the peripheral speed of the development roller 25. FIGS. 12A, 12B, and 12C are graphs each illustrating a fluctuation of the peripheral speed of the development roller 25 in a case where a driving force is input into a driving force input member 37 so that the peripheral speed of the development roller 25 is 310 [mm/s] and the peripheral speed of the toner feed roller 34 is 520 [mm/s]. FIG. 12A illustrates a case where any of the configurations A, B, and C are not implemented. FIG. 12B illustrates a case where the configuration A is implemented, and the configurations B and C are not implemented. FIG. 12C illustrates a case where all the configurations A, B, and C are implemented. As shown in the graphs, the fluctuation amplitude of the peripheral speed of the development roller 25 is able to be suppressed by implementation of the configuration A. Further, no difference in effects is found between the case where all the configurations A, B, and C are implemented and the case where only the configuration A is implemented. Meanwhile, in a case where a member is mounted to a shaft without play in the rotational direction, a member has to be press-fitted into a shaft with a predetermined pressure. Therefore, ease of assembly in this case is inferior to the configuration where the press-fitting is not performed. Because of the above reasons, in the present exemplary embodiment, the configuration A is implemented but the configurations B and C are not implemented. Thus, the fluctuation of the peripheral speed of the development roller 25 is suppressed and ease of assembly is not affected, at the same time.

Further, the ribs 381*c*, 381*d*, and 381*e* protrude toward a shaft center of the toner feed roller 34. As a result, misalignment of the shaft center on the engagement portion between the toner feed roller 34 and the transmission member 38 can be reduced. This configuration is more effective for suppressing an image irregularity.

As a method for fitting the transmission member 38 into the toner feed roller shaft 34*j* without play in the rotational direction of the toner feed roller shaft 34*j*, the configuration with the plurality of ribs 381 has been described. However, methods other than the formation of the ribs can produce a similar effect. For example, the inner peripheral surface 38*a* forming the hole 38*h* in the transmission member 38 can be configured to be in contact with an entire periphery of the toner feed roller shaft 34*j*. Further, a different member can be used to fill the gap between the inner peripheral surface 38*a* forming the hole 38*h* of the transmission member 38 and the toner feed roller shaft 34*j*, to eliminate play in the rotational direction. Further, in the present exemplary embodiment, the developing cartridge 4 without the photosensitive drum 1 has been described as the developing apparatus, but a cartridge having the photosensitive drawn 1 besides the development roller 25 and the toner feed roller 34 can be used as the developing apparatus.

Figure 11:
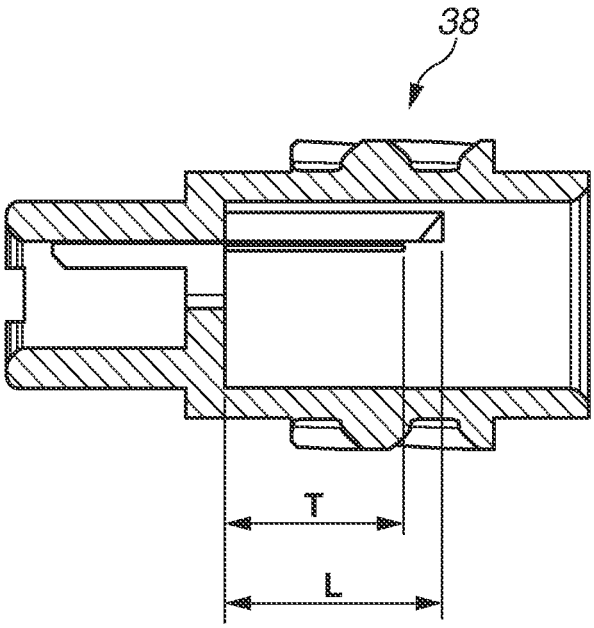
FIG. 11 is a schematic cross-sectional view illustrating the driving force transmission member.

Layouts of the ribs 381 at the engagement portion between the toner feed roller 34 and the transmission member 38 will be described below with reference to FIG. 11. FIG. 11 is a cross-sectional view illustrating the transmission member 38 viewed from a radial direction of the toner feed roller 34. As illustrated in FIG. 11, in a longitudinal direction of the toner feed roller 34, a length T of the ribs 381 is shorter than a distance L of the engagement between the driving force transmission portion 34*b* of the toner feed roller 34 and the transmission member 38. The length T and the distance L have a relationship of L>T, and a press-fitted portion is thus limited to a part of the engagement portion. As a result, a resistance of when the transmission member 38 is mounted to the toner feed roller 34 can be reduced. Because the length of the ribs 381 is adjusted, ease of assembly can be less affected by press-fitting.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-166002, filed Aug. 30, 2017, which is hereby incorporated by reference herein in its entirety.

What is claimed is:

1. A developing apparatus comprising:

a developer carrying roller configured to carry developer and to be rotatable; and a developer supply roller configured to supply the developer to the developer carrying roller and to be rotatable around a rotational axis, the developer supply roller including a shaft extending in a direction of the rotational axis, and a coupling and a gear disposed at a first end portion of the shaft and a second end portion of the shaft opposite to the first end portion in the direction of the rotational axis, respectively, wherein the coupling is configured to receive a driving force for rotating the developer supply roller, and the gear is configured to output the driving force toward the developer carrying roller, wherein the gear is provided with a hole into which the shaft is press-fitted, the hole being a space surrounded by an inner circumferential surface centered on the rotational axis and a first flat surface adjacent to the inner circumferential surface in a rotational direction of the developer supply roller, and the shaft includes an outer circumferential surface centered on the rotational axis and facing the inner circumferential surface of the gear and a second flat surface adjacent to the outer circumferential surface in the rotational direction of the developer supply roller and facing the first flat surface of the gear, and the gear is provided with a recessed portion recessed from the first flat surface of the gear, the recessed portion being apart from the second flat surface of the shaft so as not to contact with the second flat surface of the shaft, and wherein a first plurality of protrusions are disposed on the inner circumferential surface of the gear so as to contact with the outer circumferential surface of the shaft and so as to provide an interference fit between the inner circumferential surface of the gear and the outer circumferential surface of the shaft, and a plurality of second protrusions are disposed on the first flat surface of the gear so as to contact with the second flat surface of the shaft and so as to provide an interference fit between the first flat surface of the gear and the second flat surface of the shaft, the plurality of second protrusions including third protrusion arranged on a first region of the first flat surface and fourth protrusion arranged on a second region of the first flat surface opposite to the first region across the recessed portion when viewed in the direction of the rotational axis.

2. The developing apparatus according to claim 1, wherein the driving force receiving member is a coupling mounted to the shaft with play in the rotational direction of the developer supply member with respect to the shaft.

3. The developing apparatus according to claim 1, wherein when the gear and the shaft are a first gear and a first shaft, respectively and the developer carrying roller includes a second shaft extending in the direction of the rotational axis and a second gear disposed at an end of the second shaft on a side of the first gear in the direction of the rotational axis and engaging with the first gear, and wherein the second gear is mounted to the second shaft so that play is present in the rotational direction of the developer carrying roller with respect to the second shaft.

4. The developing apparatus according to claim 1, wherein the rotational direction of the developer supply roller is opposite to a rotational direction of the developer carrying roller.

5. The developing apparatus according to claim 1, wherein the number of the plurality of first protrusions is larger than the number of the plurality of second protrusions.

6. The developing apparatus according to claim 1, wherein when viewed in the direction of the rotational axis, a distance along the inner circumferential surface between a boundary, between the inner circumferential surface and the first flat surface, and one of the plurality of protrusions closest to the boundary is shorter than a distance along the inner circumferential surface between adjacent ones of the plurality of protrusions.

* * * * *